US010890023B2

(12) United States Patent
Mccafferty

(10) Patent No.: US 10,890,023 B2
(45) Date of Patent: Jan. 12, 2021

(54) SAFE ENCLOSURE HINGE INTEGRATED STOP

(71) Applicant: NCR Corporation, Duluth, GA (US)

(72) Inventor: Liam Fraser Mccafferty, Dundee (GB)

(73) Assignee: NCR Corporation, Atlanta, GA (US)

( * ) Notice: Subject to any disclaimer, the term of this patent is extended or adjusted under 35 U.S.C. 154(b) by 91 days.

(21) Appl. No.: 15/785,624

(22) Filed: Oct. 17, 2017

(65) Prior Publication Data

US 2019/0112853 A1 Apr. 18, 2019

(51) Int. Cl.

| | |
|---|---|
| ***E05D 11/06*** | (2006.01) |
| ***E05D 5/14*** | (2006.01) |
| ***E05D 7/14*** | (2006.01) |
| *E05D 3/02* | (2006.01) |

(52) U.S. Cl.

CPC ..... *E05D 11/06* (2013.01); *E05D 5/14* (2013.01); *E05D 7/14* (2013.01); *E05D 3/02* (2013.01)

(58) Field of Classification Search

CPC .. E05D 7/14; E05D 11/06; E05D 5/14; E05D 5/16; E05D 7/1044; E05D 7/105; E05D 7/1055; E05D 7/12; E05D 7/123; E05D 2007/126

USPC ..... 16/376, 374, 377

See application file for complete search history.

(56) References Cited

U.S. PATENT DOCUMENTS 403,772 A * 5/1889 Old ..... E05D 11/06 16/376
414,905 A * 11/1889 Helbing ..... E05D 11/06 16/376
546,816 A * 9/1895 Hood ..... F16C 11/04 403/116
2,347,981 A * 5/1944 Apfelbaum ..... E05D 7/1061 16/374
2,641,018 A * 6/1953 Snyder ..... E05D 1/04 16/356
2,960,296 A * 11/1960 Sepp, Jr. ..... B64D 17/70 16/304
3,298,537 A * 1/1967 Di Marco ..... A47F 7/24 211/200
3,423,787 A * 1/1969 Horstman ..... E05D 1/04 16/273
3,538,539 A * 11/1970 Dale ..... E05D 11/06 16/375
4,501,045 A * 2/1985 Boyer ..... E05D 11/06 16/331
5,075,928 A * 12/1991 Bobrowski ..... E05D 5/06 16/273
5,141,124 A * 8/1992 Smith ..... B65F 1/1468 220/831
5,217,135 A * 6/1993 Smith ..... B65F 1/1646 220/831
5,287,596 A * 2/1994 Chen ..... E05D 11/06 16/331

(Continued)

*Primary Examiner* — Jeffrey O'Brien
(74) *Attorney, Agent, or Firm* — Schwegman, Lundberg & Woessner

(57) ABSTRACT

Door hinges on safe doors include recessed areas within the holes and the recessed areas include partial obstructions. Body hinges on safe bodies include protruding appendages. The appendages fit inside the recessed areas and during circular movement of the doors the doors are stopped when the protruding appendages abut and are blocked by ends the partial obstructions.

9 Claims, 12 Drawing Sheets

(56) References Cited

U.S. PATENT DOCUMENTS 5,289,616 A * 3/1994 Taniyama ..... E05D 11/06 16/374
5,334,354 A * 8/1994 Johnston ..... B01L 9/50 16/304
5,493,760 A * 2/1996 Takimoto ..... E05D 3/12 16/366
5,740,850 A * 4/1998 Hoffman ..... E05D 1/04 160/183
5,809,617 A * 9/1998 Harris ..... E05D 1/04 16/267
6,286,187 B1 * 9/2001 Chang ..... E05D 11/02 16/340
6,321,416 B1 * 11/2001 Lu ..... G06F 1/1616 16/338
6,353,967 B1 * 3/2002 Escobar ..... E05D 3/02 16/331
6,353,970 B1 * 3/2002 Spaeth ..... B60N 2/20 16/360
6,681,447 B2 * 1/2004 Houk, Jr. ..... E05D 5/12 16/260
6,820,307 B2 * 11/2004 Lu ..... G06F 1/1679 16/341
7,234,204 B2 * 6/2007 Liu ..... G06F 1/162 16/367
7,290,581 B2 * 11/2007 Lee ..... E05D 3/12 16/381
7,530,145 B2 * 5/2009 Ge ..... H04M 1/0216 16/328
7,596,832 B2 * 10/2009 Hsieh ..... E05D 11/06 16/342
7,607,202 B1 * 10/2009 Lee ..... G06F 1/1616 16/342
7,743,468 B2 * 6/2010 Chang ..... G06F 1/162 16/367
8,060,985 B2 * 11/2011 Lin ..... E05D 11/082 16/342
8,099,834 B2 * 1/2012 Corso ..... E05D 5/12 16/342
8,479,359 B2 * 7/2013 Yabe ..... H04M 1/0216 16/376
8,646,154 B2 * 2/2014 Smith ..... E05D 11/06 16/374
8,695,166 B2 * 4/2014 Wang ..... G06F 1/1681 16/337
8,739,366 B2 * 6/2014 Heninger ..... E05D 5/10 16/374
8,870,278 B2 * 10/2014 Tsai ..... A47B 3/02 297/19
8,919,872 B2 * 12/2014 Tsai ..... A47B 3/02 297/56
9,068,382 B1 * 6/2015 Hall ..... E05D 11/06
9,447,621 B2 * 9/2016 Kalinowski ..... E05D 11/1007
10,100,571 B2 * 10/2018 Deman ..... E05D 3/186
2004/0134036 A1 * 7/2004 Home ..... A47J 36/12 16/363
2005/0125948 A1 * 6/2005 Pinto ..... E05D 5/04 16/226
2005/0198780 A1 * 9/2005 Liu ..... E05D 3/10 16/367
2008/0149009 A1 * 6/2008 Boyes ..... E05D 7/14 109/73
2008/0245112 A1 * 10/2008 Sung ..... D06F 39/14 68/12.26
2009/0007384 A1 * 1/2009 Lin ..... E05D 11/06 16/375
2010/0125977 A1 * 5/2010 Shen ..... G06F 1/1681 16/375
2010/0264696 A1 * 10/2010 Tuhy ..... E02F 3/3414 296/190.11
2011/0154613 A1 * 6/2011 Chang ..... E05D 3/02 16/273
2013/0021726 A1 * 1/2013 Yang ..... H04M 1/0216 361/679.01
2014/0173852 A1 * 6/2014 Heninger ..... E05D 5/14 16/375
2015/0345197 A1 * 12/2015 Tsai ..... A47B 3/02 297/16.1
2016/0186475 A1 * 6/2016 Moore ..... E05D 11/06 16/374
2017/0022740 A1 * 1/2017 Hall ..... E05D 11/06
2018/0030766 A1 * 2/2018 Yeom ..... E05D 7/086
2018/0180372 A1 * 6/2018 Scott ..... F41A 23/18

* cited by examiner

SAFE ENCLOSURE HINGE INTEGRATED STOP

BACKGROUND

A standard safe enclosure utilizes a stay bar at the base of the safe door and body. This is to allow the safe door to stay open and prevents the safe door from opening too far. At least five components are needed for the stay bar assembly and its protrusion from the bottom of the safe door obstructs easy access into the safe enclosure.

Also, when the safe enclosure is racked, proper space must be accounted for in order to accommodate the standard stay bar. This adds to the height requirements of the safe enclosure and may be problematic for compliance of governmental regulations.

Existing designs that have eliminated the stay bar include a molded gap that permits the safe door to open a predefined amount and stops the door from opening too far. This molded gap in the safe door hinge works as a safe door stop. FIG. 1 illustrates a conventional safe door stop with the molded gap 100 in the safe door hinge.

The problem with these approaches that replace the safe stay bar is that fingers, clothing, and other materials can be caught in the gap 100 when the safe door is opened and closed. Additionally, the gap 100 causes paint on the door to chip around the gap area, which adds to the maintenance of the safe door.

SUMMARY

In various embodiments, an apparatus and a method for a safe enclosure hinge integrated stop is presented.

According to an embodiment, an apparatus is presented. The apparatus includes: 1) at least one door hinge having a hole through the door hinge that includes a partial obstruction in a first portion of the hole, and 2) at least one body hinge having a second hole through the body hinge that includes a partial protrusion that extends from a bottom of the second The first hole and second hole are aligned with the partial protrusion fitting inside a second portion of the hole and a range of circular motion of a door having the at least one door hinge restricted by the partial obstruction when the partial protrusion abuts with ends of the partial obstruction.

DETAILED DESCRIPTION

Figure 2A:
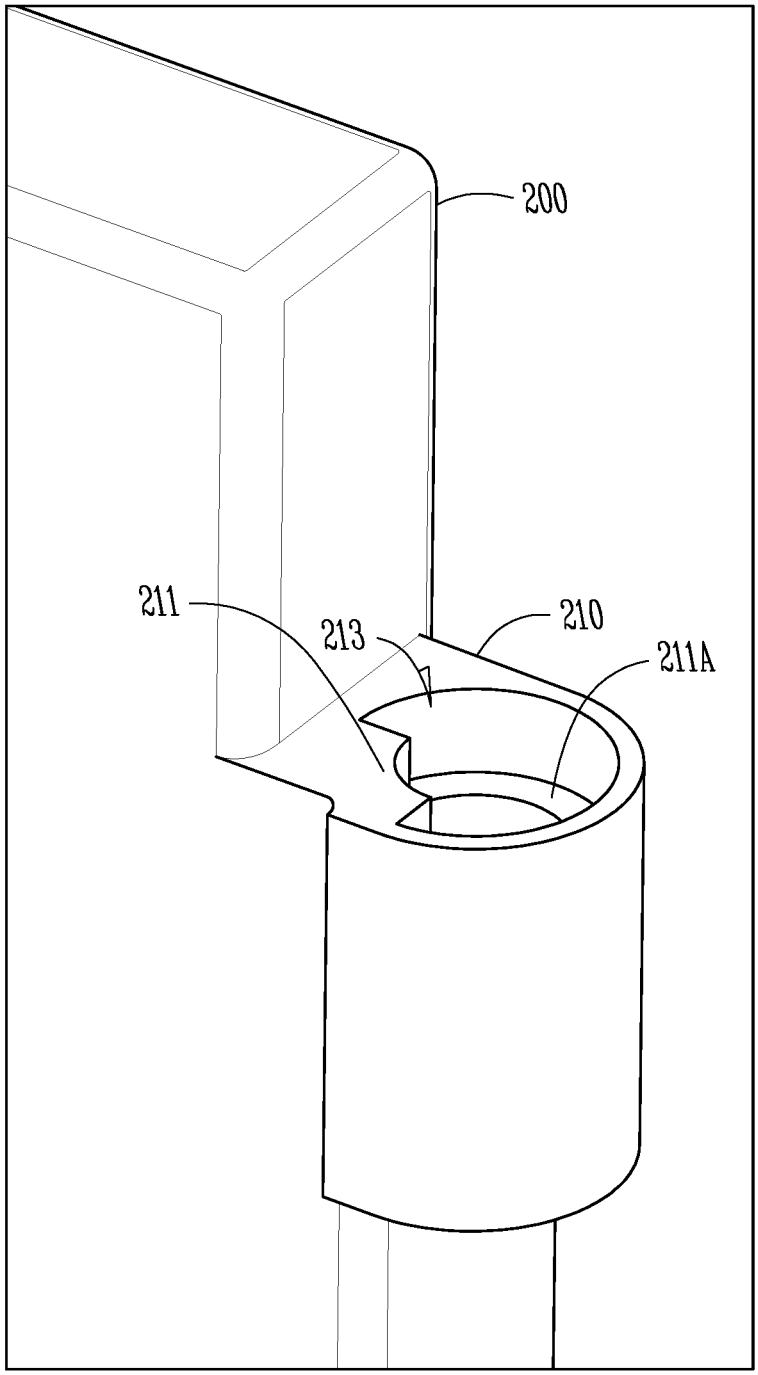
FIG. 2A is a diagram of a safe enclosure door having an integrated hinge stop, according to an example embodiment.

FIG. 2A is a diagram of a safe enclosure door having an integrated hinge stop, according to an example embodiment.

The safe enclosure door 200 (hereinafter just door 200) includes at least one hinge component 210 (hereinafter "door hinge 210"). The door hinge 210 is offset from a top surface of the door 200 and extends vertically along a side surface of the door 200. The offset distance is manufactured to ensure that a male component 222 (shown in the FIG. 2B) of the safe enclosure body 220 (hereinafter just "body 200") fits snuggly into a recess area of the door hinge 210 when properly aligned to a female component 211 of the door hinge 210 (shown in the FIG. 2C below).

The door hinge 210 includes the female component 211 and recessed area surface 211A. The opening of the door hinge 210 includes a hole having first diameter that extends from the top of the opening to the recessed area surface 211A, the hole includes a smaller diameter from the top of the recessed area surface 211A through a remaining length of the door hinge 210. In an embodiment, the smaller diameter is about a half of an inch and is substantially the same diameter of a door pin 230 (shown in the FIG. 2F).

In an embodiment, the offset length from a top of the door hinge 210 to the recessed area surface 211A is approximately 18 mm.

In an embodiment, the door 200 includes a second hinge 210 having a second female component 211 and a second recessed surface area 211A and is along the side surface extending from a bottom of the door at an offset to match a corresponding male component 222 of the body 200.

In an embodiment, the female component 211 extends along the top of the recessed area surface 211A for 90 degrees leaving an exposed and unobstructed area of the recessed area surface 211A that extends for approximately 270 degrees.

The door hinge 211 or door hinges 211 are situated along the side surface to align with corresponding male components 222 of the body hinges 221 of the body 220.

Figure 2B:
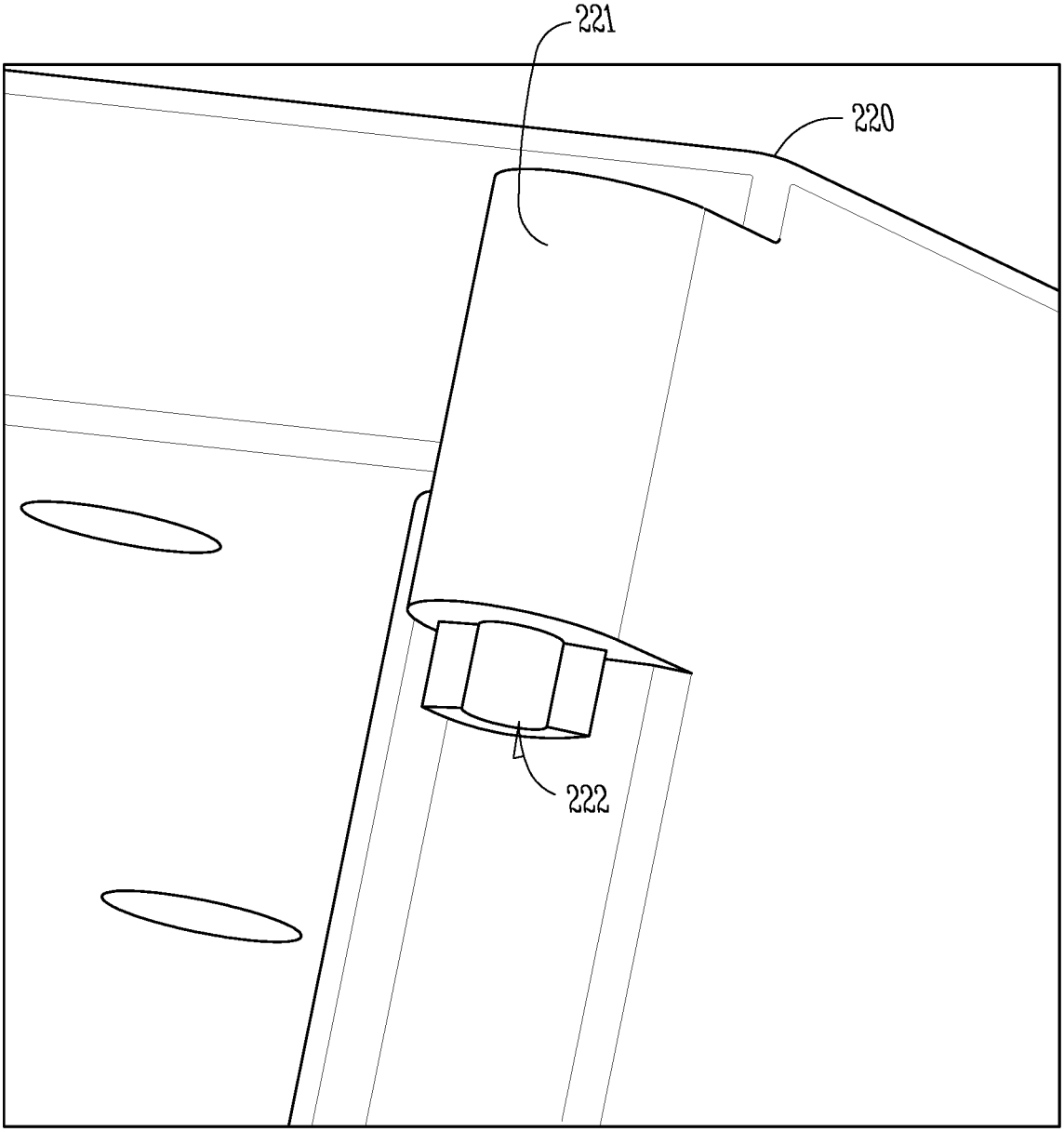
FIG. 2B is a diagram of a safe enclosure having an integrated hinge stop, according to an example embodiment.

FIG. 2B is a diagram of a safe enclosure (body 220) having an integrated hinge stop (body hinge 221), according to an example embodiment.

The body 220 includes at least one body hinge 221. The body hinge 221 includes a male component 222 that extends from a bottom of the body hinge 221 for a predefined distance. In an embodiment, the extension length of the male component 222 is approximately 10-15 mm. In an embodiment, the door hinge's recessed surface area 211A begins at approximately a depth of 18 mm from the top of the door hinge 211. This ensures that the male component 222 fits into the opening of the door hinge 211 and is stopped by the recessed surface area 211A from performing a full 360 degrees circular motion about the vertical axis of the hole through the body hinge 221.

The male component 222 extends from the body hinge 221 for approximately 140 degrees. The male component 222 is a semicircle and includes a side surface permitting the pin 230 to slide along the side surface through for the length of the body hinge 221 and through the opening of the door hinge 211 for the length of the door hinge 211.

Figure 2C:
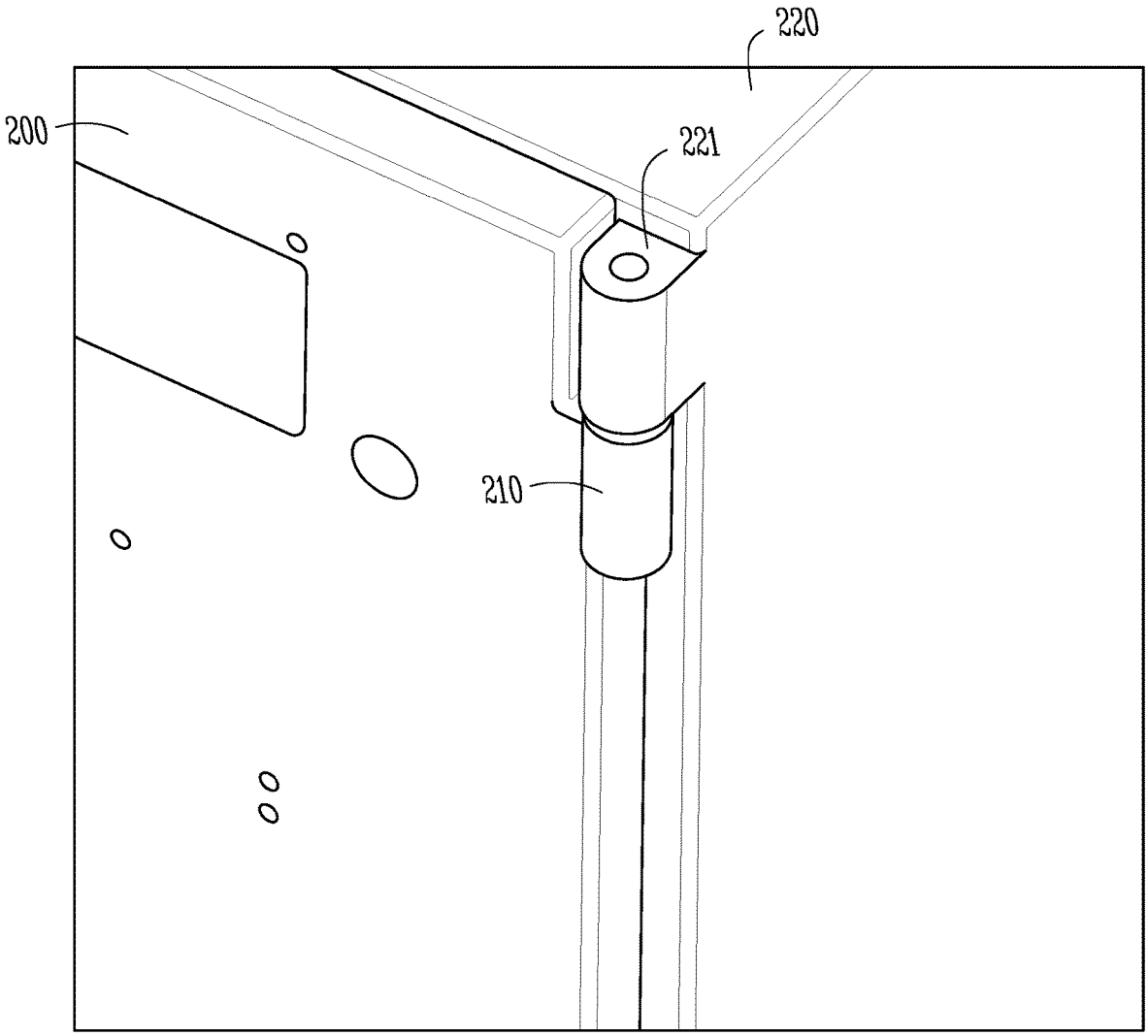
FIG. 2C is a diagram of the safe door attached to a safe enclosure through the integrated hinge stop, according to an example embodiment.

FIG. 2C is a diagram of the safe door (door 200) aligned with a safe enclosure (body 220) through the integrated hinge stops (210, 211, 220, and 222), according to an example embodiment.

A top of the body hinge 221 is aligned above the door hinge 210. The male component 222 fits into the opening of the door hinge 210 such that the male component 222 abuts the female component 211 and is movable along the recessed surface area 211A for an additional range of motion before encountering an opposite side wall of the female component 211.

Similarly, the bottom door hinge 210 is aligned with a bottom body hinge 221. Once aligned a single pin or two separate pins (one for each pair of hinges 210 and 221) are inserted into the holes of the hinges 210 and 221 and secured into place (to thwart any attempt to remove the pin or pins). The door 210 is then secured to the body 220.

Figure 1:
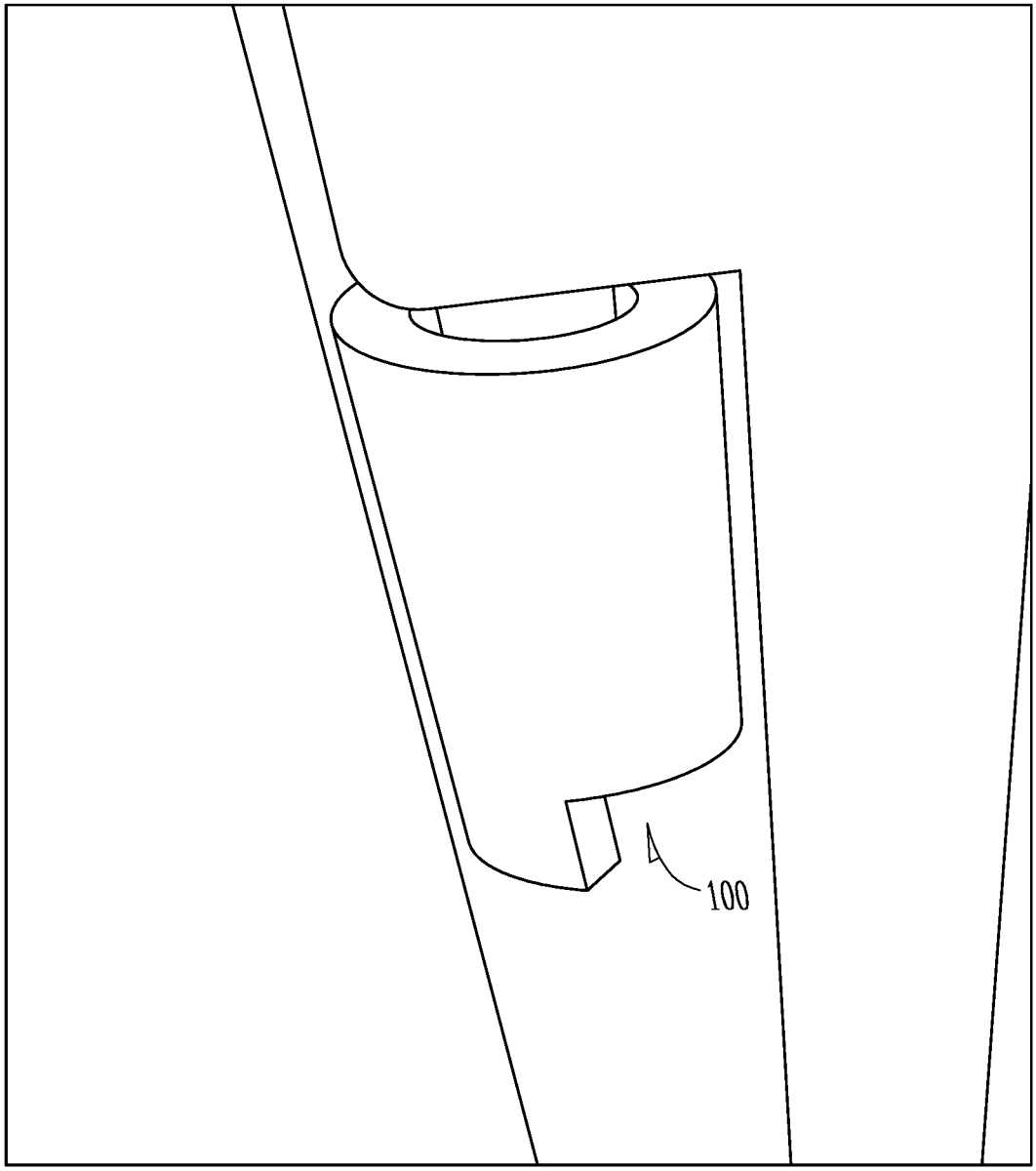
Fig. 1 (Prior Art)
FIG. 1 is a diagram of existing safe door hinge apparatus that replaces a standard safe door stay bar.

The exposed recessed area 211A extends for approximate 270 degrees (the remaining 90 degrees occupied by the female component 211. The male component 222 extends for approximately 140 degrees. This means that the door 210 can swing to a fully opened position of about 130 degrees (shown in the FIG. 2J). The female component 211 acts as stop with the male component 222 when the male component 222 is moved about a vertical axis through the center of the hole in the hinges 210 and 221. This is achieved without requiring any stay bar and without having a manufactured gap in the door hinge 210. Conventionally, this gap 100 (as shown in the FIG. 1) creates a hazard for body parts of a safe operator or clothing and other materials, and the gap causes chipping of paint on safe door hinges.

Figure 2D:
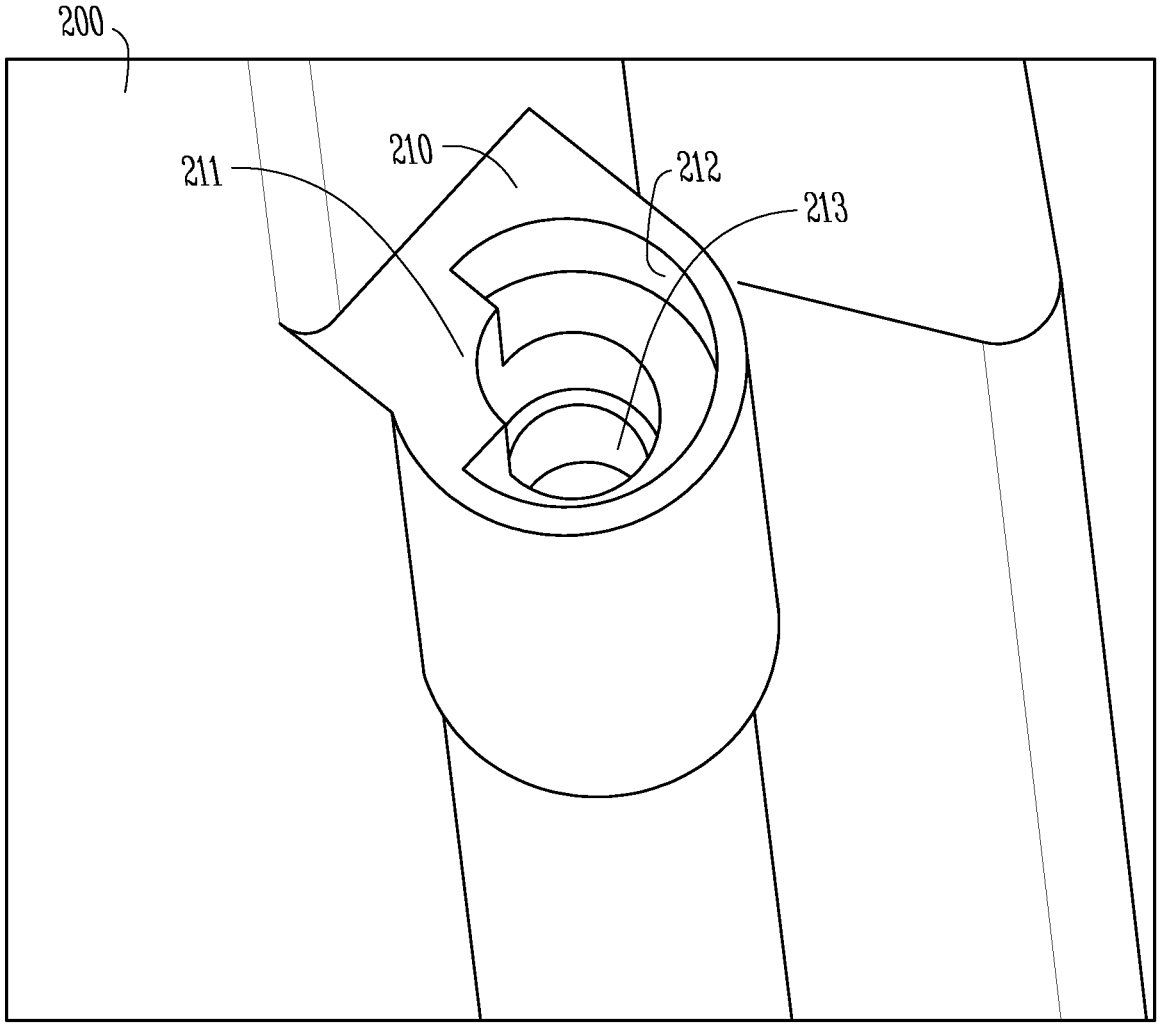
FIG. 2D is a diagram of a top-down view of the safe enclosure door having the integrated hinge stop, according to an example embodiment.

FIG. 2D is a diagram of a top-down view of the safe enclosure door (door 200) having the integrated hinge stop (female component 211), according to an example embodiment.

The female component 211 extends out from the opening to partially abut the hole 213 through which the pin 230 is inserted to fasten the door 200 to the body 220. The length of the female component 211 extends for approximately 90 degrees.

The recessed area surface 212 has a larger diameter than the hole 213 and extends for approximately 270 degrees. The depth from the top of the door hinge 210 to reach the recessed area surface 212 is approximately 18 mm.

Figure 2E:
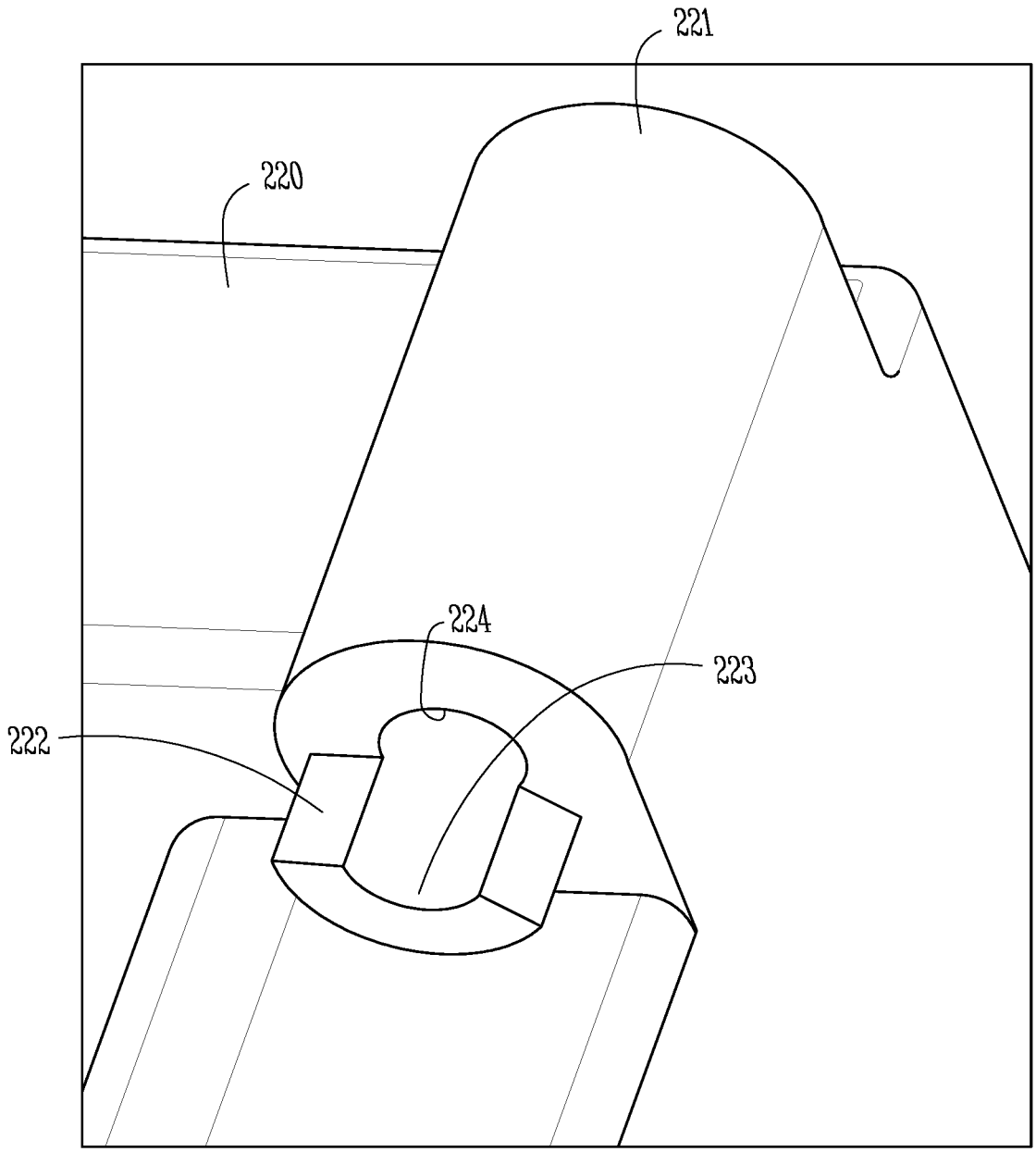
FIG. 2E is another diagram of the safe enclosure having the integrated hinge stop, according to an example embodiment.

FIG. 2E is another diagram of the safe enclosure (body 220) having the integrated hinge stop (male component 222), according to an example embodiment.

The male component 222 extends from a bottom of the body hinge 221 for approximately 10-15 mm. The male component 222 is a semicircle protrusion from the bottom of the body hinge 221 that extends for approximately 140 degrees along the bottom of the body hinge 221. The male component has a pin abutment surface 223 that aligns and abuts the pin 230 when the pin 230 is inserted through hole 224, which extends for the length of the body hinge 221.

Figure 2F:
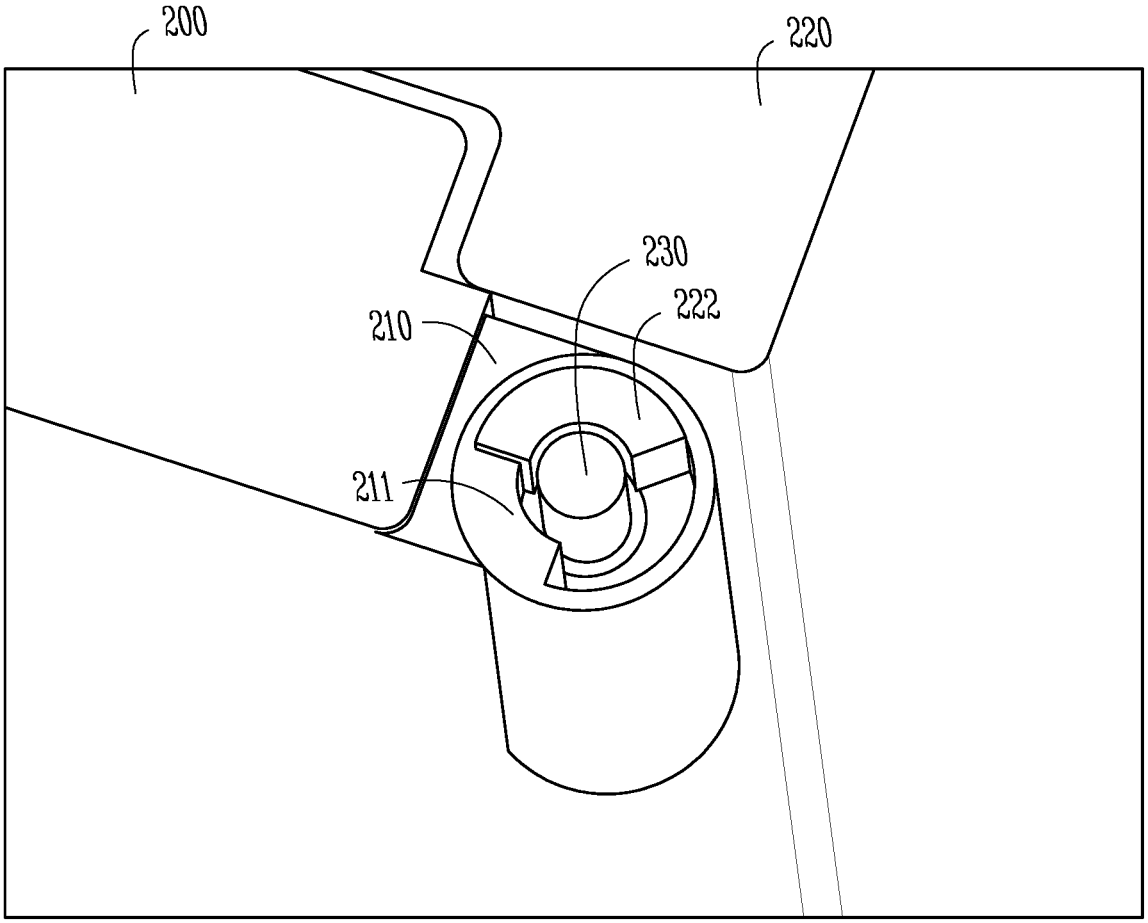
FIG. 2F is a diagram of the safe door in a closed position and affixed to the safe enclosure through the integrated hinge stop, according to an example embodiment.

FIG. 2F is a diagram of the safe door (door 200) in a closed position and affixed to the safe enclosure (body 220) through the integrated hinge stop (211 and 222), according to an example embodiment.

The FIG. 2F is a cut away cross-sectional view of the male component 222 for the body 220 of body hinge 221 inserted into the recessed area 211A of the door hinge 210 for the door 200 with a pin 230 to affix the door 200 to the body 220. In the closed position, one side of the male component 222 abuts and is stopped by one side of the female component 211. The male component 222 can move within the recessed area on the recessed area surface 211A for approximately 130 degrees (given a length of the male component extending for 140 degrees and the length of the female component 211 extending for 270 degrees).

Figure 2G:
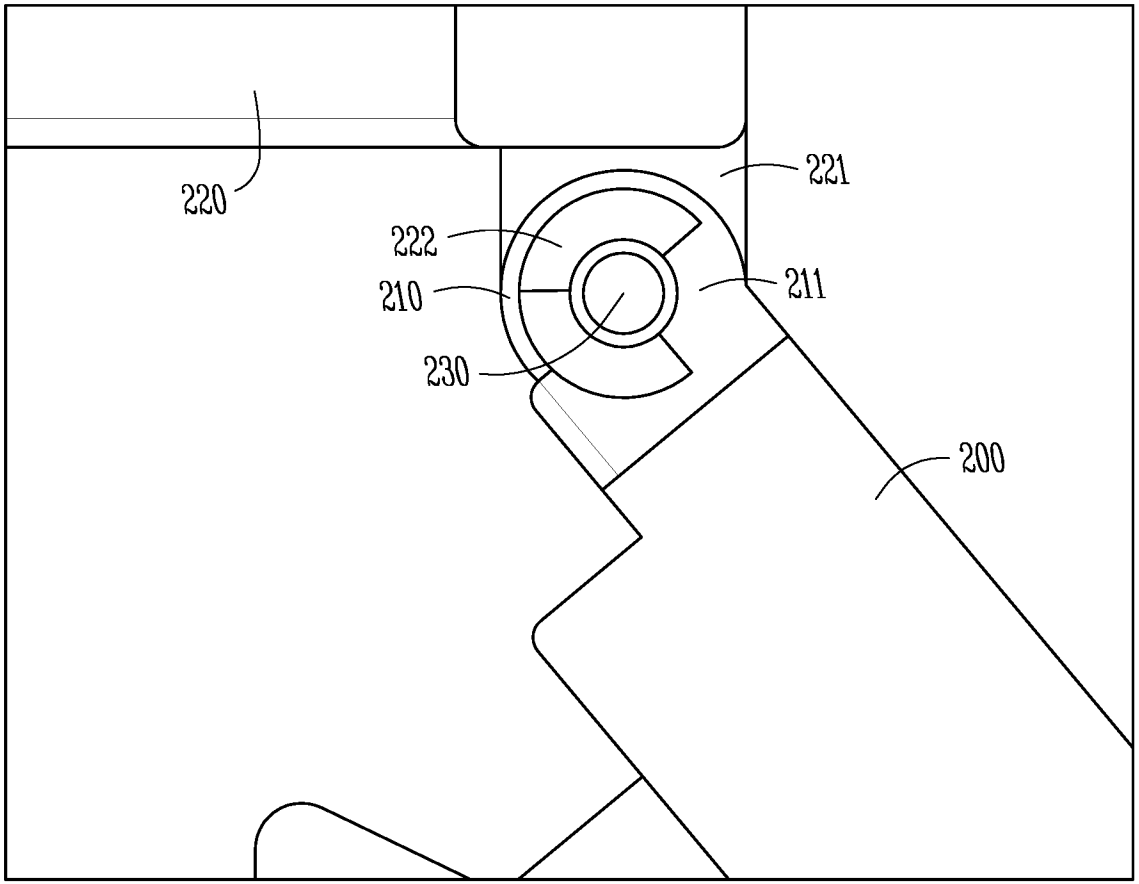
FIG. 2G is a diagram of the safe door in an open position and affixed to the safe enclosure through the integrated hinge stop, according to an example embodiment.

FIG. 2G is a diagram of the safe door (door 200) in an open position and affixed to the safe enclosure (body 220) through the integrated hinge stop (211 and 222), according to an example embodiment.

Again the FIG. 2G is a cut away cross-sectional view of the male component 222 for the body 220 of the body hinge 221 inserted into recessed area 211A of the door hinge 210 for the door 200 with a pin 230 to affix the door 200 to the body 220. In the open position, the door 200 is only permitted to open when the male component 222 is not stopped by or abutting the female component 211. This open position is approximately 130 degrees as discussed above.

Figure 2H:
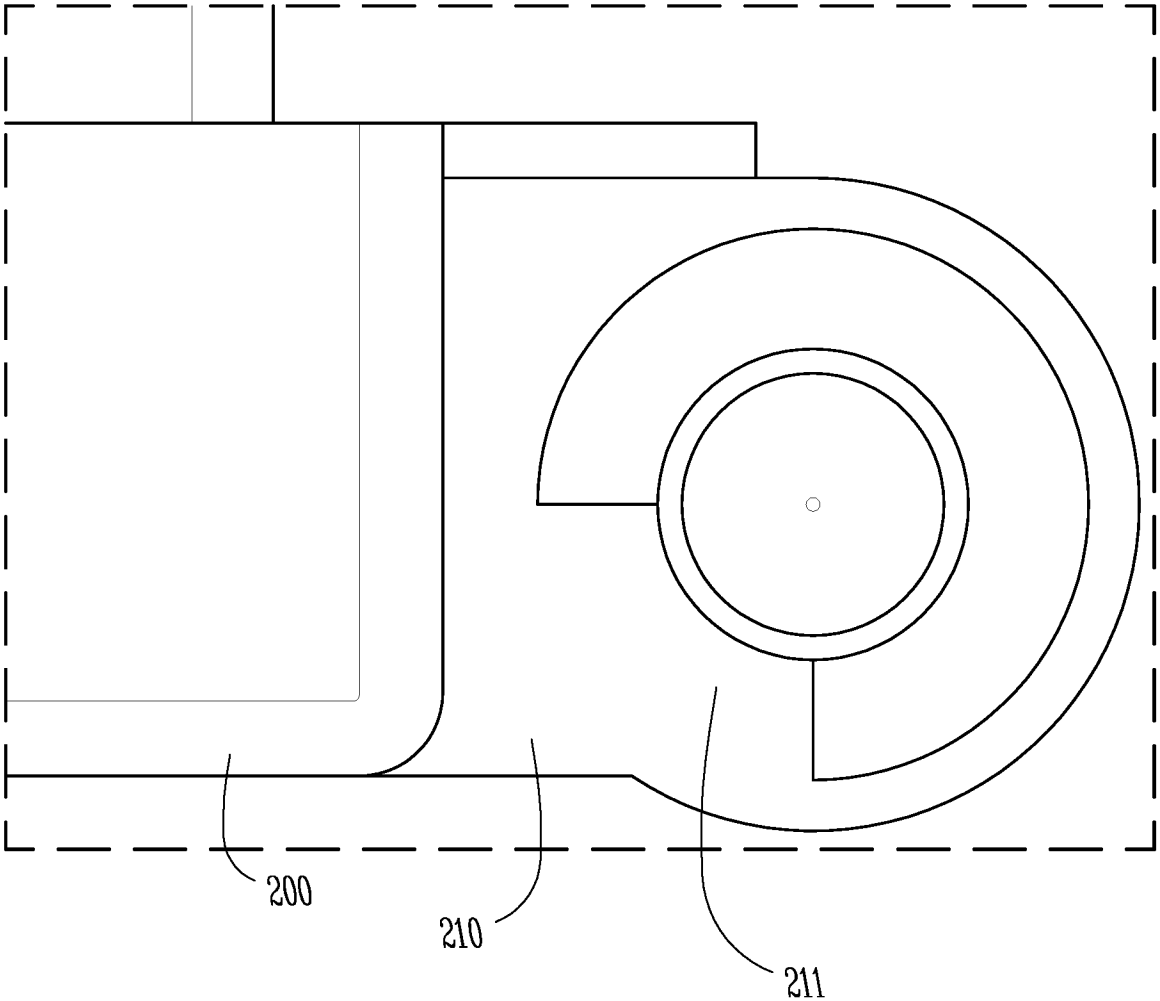
FIG. 2H is a diagram of a top-down view of the safe enclosure door having the integrated hinge stop, according to an example embodiment.

FIG. 2H is a diagram of a top-down view of the safe enclosure door (door 200) having the integrated hinge stop (door hinge 210), according to an example embodiment.

The hole through the door hinge 210 includes two diameters. The first diameter is plugged for 90 degrees along the hole by the female component 211. The remaining 270 degrees includes a recessed area surface 211A where the first diameter is shortened to a second diameter that is slightly larger than the diameter of the pin 230. The depth from the top of the door hinge 210 hole to the recessed surface area 211A is approximately 18 mm.

Figure 2I:
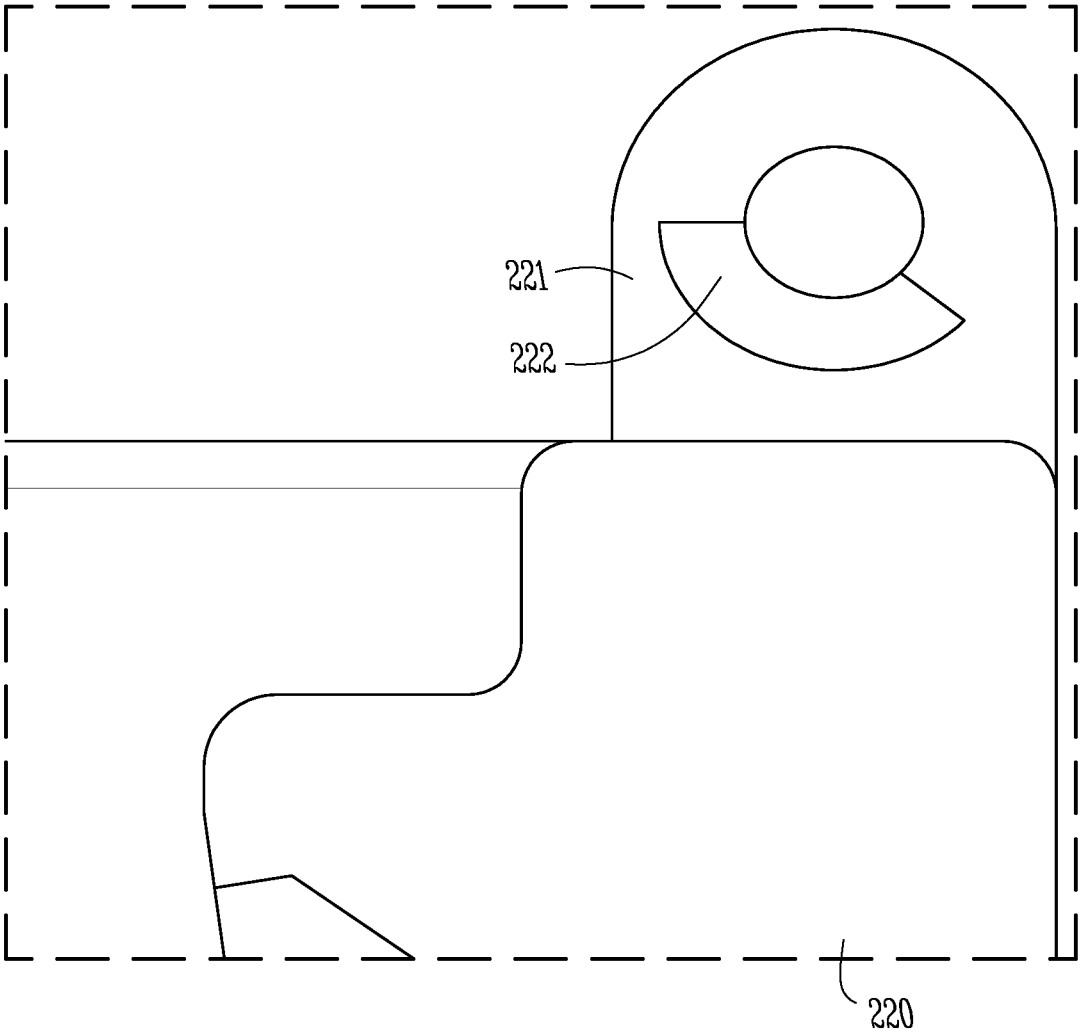
FIG. 2I is a diagram of a top-down view of the safe enclosure having the integrated hinge stop, according to an example embodiment.

FIG. 2I is a diagram of a top-down view of the safe enclosure (body 220) having the integrated hinge stop (body hinge 221), according to an example embodiment.

The male component 222 extends from a bottom of the body hinge 221 for approximately 10-15 mm and first snugly inside the hole of the door hinge 210 and is stopped or blocked by the female component 211, such that the male component 222 moves circularly about a vertical axis for approximately 130 degrees.

Figure 2J:
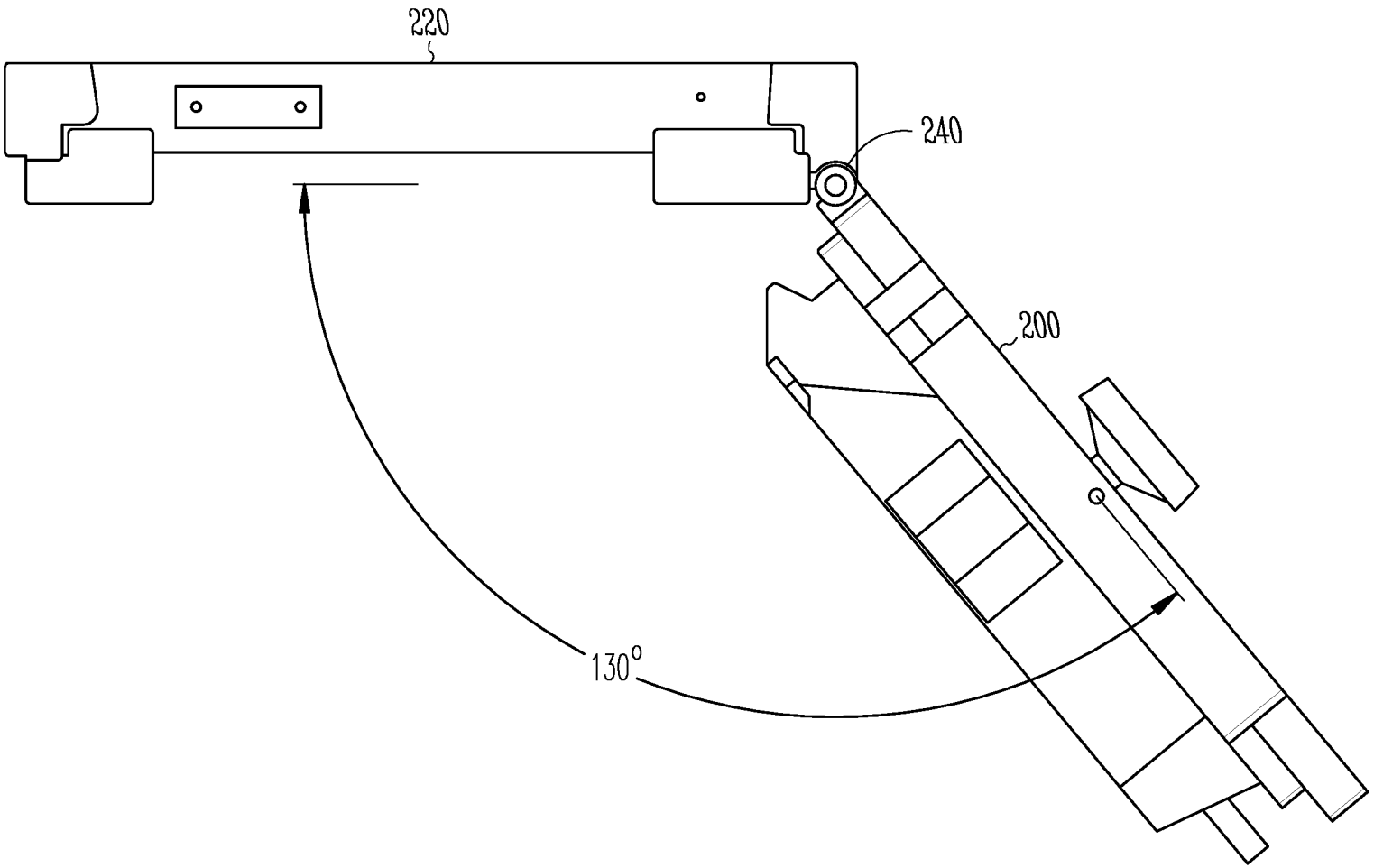
FIG. 2J is a diagram of a top-down view of the safe enclosure door in an open position and affixed to the safe enclosure through the integrated hinge stop, according to an example embodiment.

FIG. 2J is a diagram of a top-down view of the safe enclosure door (door 200) in an open position and affixed to the safe enclosure (body 220) through the integrated hinge stop (210 and 221), according to an example embodiment.

The FIG. 2J illustrates the degree of motion that the door 200 is capable of achieving (130 degrees) given the stops (when the male component 222 encounters and abuts the female component 211 when the door 200 is opened.

It is to be noted that although the door 200 was discussed with a single hinge 210 and the body 220 was discussed with a single hinge 221, two hinges can be used having the features and structures discussed herein. Additionally, a single pin can be fastened through all the hinges or a separate pin can be used with each pair of hinges.

In an embodiment, the body 220 and door 200 together form a safe for an Automated Teller Machine (ATM) and/or a Self-Service Terminal (SST).

Figure 3:
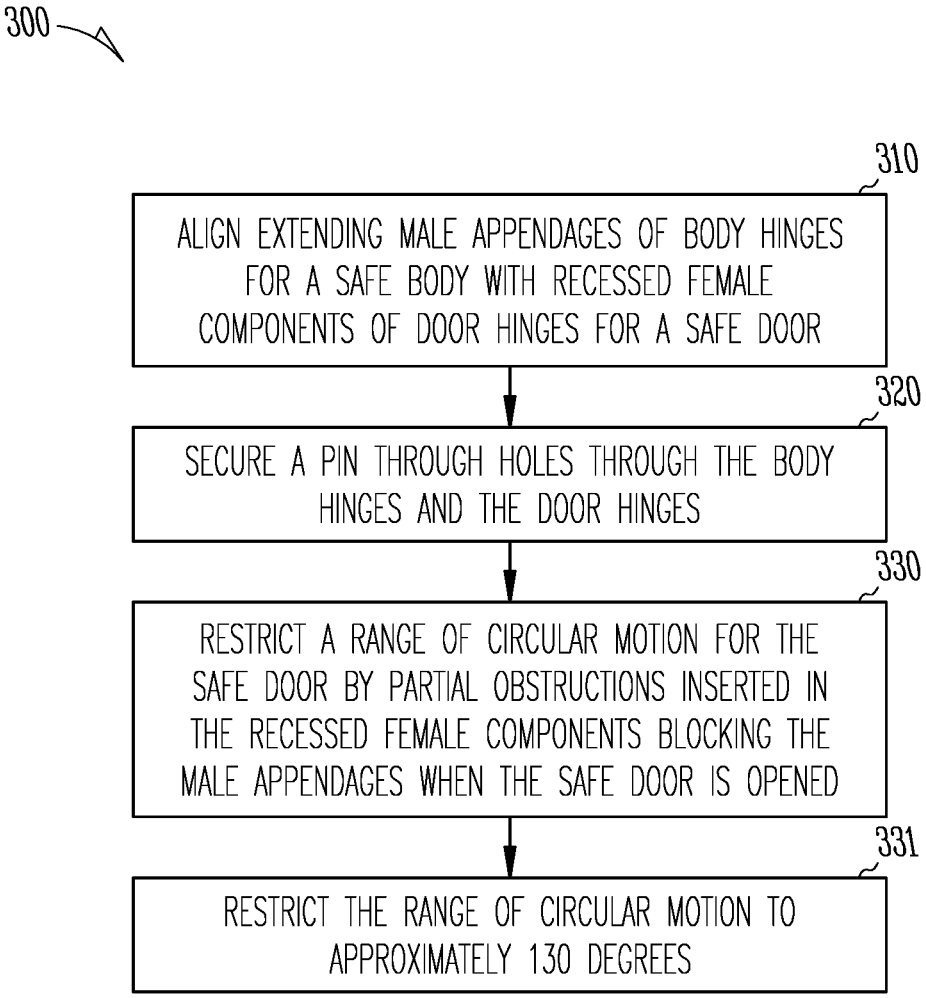
FIG. 3 is a diagram of a method of providing a safe enclosure hinge integrated stop apparatus, according to an example embodiment.

FIG. 3 is a diagram of a method 300 of providing a safe enclosure hinge integrated stop apparatus, according to an example embodiment.

At 310, extending male appendages of body hinges for a safe body are aligned with recessed female components of door hinges for a safe door.

At 320, a pin is secured through holes through the body hinges and the door hinges.

At 330, a range of circular motion for the safe door is restricted by partial obstructions inserted in the recessed female components blocking the male appendages when the safe door is opened.

According to an embodiment, at 331, the range of circular motion is restricted to approximately 130 degrees.

For the embodiments presented herein, the safe doors and safe bodies do not have stay bars and the door hinges do not have any externally facing manufactured gap.

One now appreciates how an integrated hinge stop manufactured on safe doors and safe bodies can provided an improved safe door stop with acceptable range of motion and without any of the problems associated with conventional stay bars and manufactured gaps 100 in safe door hinges.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. An apparatus, comprising:

a safe comprising a safe door and a safe body;

the safe door comprising at least one door hinge;

the safe body comprising at least one body hinge;

the at least one door hinge having a first hole with a first diameter extending through the door hinge and a first counterbore with a second diameter greater than the first diameter extending coaxially with the first hole, the first counterbore includes a partial obstruction in a first portion of the first counterbore; and the at least one body hinge having a second hole through the body hinge that includes a partial protrusion that extends from a bottom of the second hole;

wherein the first hole and second hole are aligned with the partial protrusion fitting inside a second portion of the first counterbore and a range of circular motion of the safe door having the at least one door hinge is restricted by the partial obstruction when the partial protrusion abuts with ends of the partial obstruction;

wherein a pin is adapted to be inserted through the first hole, the first counterbore, and the second hole after the partial protrusion is inserted into the second portion of the first counterbore to secure the safe door to the safe body;

wherein the at least one door hinge is offset from a top surface of the safe door and extends vertically along a side surface of the safe door;

wherein the safe door is adapted to swing to a fully opened position of 130 degrees for the range of circular motion without a stay bar.

2. The apparatus of claim 1, wherein the at least one door hinge includes two door hinges, and wherein the at least one body hinge includes two body hinges.

3. The apparatus of claim 1, wherein the partial obstruction extends around an inside of the first portion of the first counterbore for approximately 90 degrees.

4. The apparatus of claim 3, wherein the partial protrusion extends around a perimeter of the bottom of the second hole for approximately 140 degrees.

5. The apparatus of claim 4, wherein a height of the protrusion is approximately 10-15 mm.

6. The apparatus of claim 5, wherein the second portion of the first counterbore includes a recessed area having a depth from the top of the first hole of approximately 18 mm.

7. The apparatus of claim 6, wherein the recessed area extends around the first counterbore adjacent to the ends of the partial obstruction for approximately 270 degrees.

8. The apparatus of claim 1, wherein the partial protrusion is an arch around the bottom of the second hole.

9. The apparatus of claim 1, wherein the partial obstruction is an arch inside the first portion of the first counterbore.

* * * * *